US007699255B2

(12) United States Patent
Kapper

(10) Patent No.: US 7,699,255 B2
(45) Date of Patent: Apr. 20, 2010

(54) DISC MILL ASSEMBLY FOR PULVERIZING SYSTEM

(75) Inventor: William J. Kapper, Dalton, OH (US)

(73) Assignee: King Machine and Tool Co., Massillon, OH (US)

( * ) Notice: Subject to any disclaimer, the term of this patent is extended or adjusted under 35 U.S.C. 154(b) by 82 days.

(21) Appl. No.: 11/633,702

(22) Filed: Dec. 5, 2006

(65) Prior Publication Data

US 2007/0080250 A1 Apr. 12, 2007

Related U.S. Application Data

(62) Division of application No. 10/408,649, filed on Apr. 7, 2003, now Pat. No. 7,152,823.

(60) Provisional application No. 60/445,623, filed on Feb. 7, 2003.

(51) Int. Cl.
*B02C 7/06* (2006.01)

(52) U.S. Cl. ..... 241/261.2; 241/285.3; 241/296

(58) Field of Classification Search ..... 241/296, 241/285.3, 261.2

See application file for complete search history.

(56) References Cited

U.S. PATENT DOCUMENTS

| | | | | |
|---|---|---|---|---|
| 2,985,391 A | | 5/1961 | Parmele | |
| 3,302,893 A | | 2/1967 | Feder et al. | |
| 3,584,799 A | | 6/1971 | Feder | |
| 3,620,463 A | | 11/1971 | Feder | |
| 3,738,596 A | | 6/1973 | Miles | |
| 3,761,027 A | * | 9/1973 | Mendoza | 241/261.3 |
| 3,923,255 A | | 12/1975 | Leonard | |
| 3,931,935 A | * | 1/1976 | Holman | 241/24.1 |
| 4,018,388 A | * | 4/1977 | Andrews | 241/39 |
| 4,039,153 A | * | 8/1977 | Hoffman | 241/248 |
| 4,098,463 A | | 7/1978 | Lowry | |
| 4,109,873 A | * | 8/1978 | Lichfield | 241/56 |

(Continued)

FOREIGN PATENT DOCUMENTS

| | | |
|---|---|---|
| GB | 2 268 426 | 12/1994 |

OTHER PUBLICATIONS

Fly Wheel Detail, Dwg No. r429, Reduction Engineering, Inc., Kent, Ohio, Jun. 10, 1997.

(Continued)

*Primary Examiner*—Bena Miller
(74) *Attorney, Agent, or Firm*—Fay Sharpe LLP

(57) ABSTRACT

A disc mill assembly for a pulverizing system includes: a flywheel, a water jacket, two disc blades, and two ring clamps. In alternate embodiments, the disc mill assembly also includes: an air inlet to provide input air from an external air supply and an improved blade height adjustment mechanism. A disc blade is also provided. The disc blade is a single member with a central aperture that is the only through hole in the blade. Users may cost-effectively adopt a disposal versus sharpening policy for replacement of the disc blade. A method for controlling a temperature of material in a disc mill assembly having first and second disc blades is provided. The method includes: directing an adjustable input air stream, directing material to be ground, monitoring the temperature of the material, and controlling the air stream directing and/or the material directing in response to the temperature monitoring.

18 Claims, 8 Drawing Sheets

U.S. PATENT DOCUMENTS

| | | | | | |
|---|---|---|---|---|---|
| 4,153,208 | A | * | 5/1979 | Vomhof et al. | 241/82.4 |
| 4,623,098 | A | * | 11/1986 | Motoyama et al. | 241/46.04 |
| 4,627,959 | A | | 12/1986 | Gilman et al. | |
| 4,651,935 | A | | 3/1987 | Samosky et al. | |
| 4,796,817 | A | | 1/1989 | Zacher | |
| 4,852,811 | A | | 8/1989 | Adams et al. | |
| 5,114,080 | A | | 5/1992 | Pujol | |
| 5,193,754 | A | | 3/1993 | Pujol | |
| 5,269,470 | A | | 12/1993 | Ishikawa et al. | |
| 5,388,942 | A | * | 2/1995 | Bonacina et al. | 411/432 |
| 5,454,521 | A | * | 10/1995 | Frazier et al. | 241/51 |
| 5,462,237 | A | | 10/1995 | Wellmann | |
| 5,620,145 | A | * | 4/1997 | Masuda | 241/19 |
| 5,727,741 | A | * | 3/1998 | Gibson | 241/157 |
| 5,860,606 | A | * | 1/1999 | Tiedeman et al. | 241/55 |
| 5,882,246 | A | | 3/1999 | Inkyo et al. | |
| 6,340,022 | B1 | * | 1/2002 | Schroer | 125/13.01 |
| 6,450,428 | B1 | | 9/2002 | Kelsey | |

OTHER PUBLICATIONS

Refinery Plate, Dwg No. AG-113, Reduction Engineering, Inc., Kent, Ohio, Apr. 21, 1997.

Alternate 1 Refinery Plate, Reduction Engineering, Inc., Kent, Ohio, undated (received by King Machine & Tool Co. Feb. 22, 2005).

Alternate 2 Refinery Place and Fly Wheel Detail, Reduction Engineering, Inc., Kent, Ohio, undated (received by King Machine & Tool Co. Feb. 22, 2005).

Combination of Fly Wheel Detail, Dwg No. r429, Jun. 10, 1997, Refinery Plate, Dwg No. AG-113, Apr. 21, 1997, Alt. 1 Refinery Plate, Alt. 2 Refinery Plate & Fly Wheel Detail, and other views of alt. refinery plate & fly wheel, Reduction Engineering, Inc., Kent, Ohio, undated (received by King Machine & Tool Co. Feb. 22, 2005).

What's New—Two Pulverizer Product Developments, Reduction Engineering, <http://www.accu-grind.com/whatsnew.htm>, printed Jul. 31, 2002.

Pulverizing Machine—New Discs All Makes, Reduction Engineering, <http://www.accu-grind.com/discpage.htm>, printed Jul. 31, 2002.

Pulverizer Disc Sharpening Services, King Machine & Tool Co., <http://www.kmtco.com/pulverizing.htm>, printed Jul. 31, 2002.

International Search Report, Improved Disc Mill Assembly for Pulverizing System to King Machine and Tool Co. (PCT counterpart to U.S. parent), International Patent Application No. PCT/US03/10598, Jul. 24, 2003.

* cited by examiner

DISC MILL ASSEMBLY FOR PULVERIZING SYSTEM

This application is a divisional application of U.S. patent application Ser. No. 10/408,649, filed Apr. 7, 2003 now U.S. Pat. No. 7,152,823 entitled IMPROVED DISC MILL ASSEMBLY FOR PULVERIZING SYSTEM which claims the benefit of U.S. Provisional Pat. App. Ser. No. 60/445,623, filed on Feb. 7, 2003, the disclosures of which are fully incorporated herein by reference.

BACKGROUND

The invention relates to pulverizing systems for grinding various materials into smaller particles. It finds particular application in conjunction with an improved disc mill assembly in the pulverizing system and will be described with particular reference thereto. Typically such pulverizing systems are used to grind pelletized or shredded plastics, nylons, polyesters, and other polymers into respective powders. However, it is to be appreciated that the invention is also amenable to other applications.

Pulverizing systems with one or more disc mill assemblies are well known. Generally, such systems include a means for feeding input material to the disc mill, a means for carrying ground material from the disc mill to a sorting module, a means for transporting acceptable ground material to a ground material collection area, and a means for recirculating unacceptable ground material to a disc mill for further grinding. A current disc mill typically includes a spindle, a flywheel, a rotating disc blade, a stationary disc blade, a means for cooling the stationary disc blade (e.g., a water jacket), a means for introducing air into the mill, and a means for adjusting a gap between facing cutting surfaces of the disc blades.

Previously, the blades in disc mills were heavy in order to withstand various pressures and forces exerted on the blade. The blades were also previously held in place with bolts securing the rotating blade to the flywheel and the stationary blade to another fixed component integrated with the water jacket used to cool the blade. A problem is that the bolt holes created a weak point in the blades thus conventional designs use a thicker and heavier blade to compensate for this weakness.

Using a stationary disc blade as an integral part of the water jacket creates several additional problems. The cavity in the water jacket for circulating coolant (e.g., water) was actually formed by the back surface of the blade and a mating surface on the other component defining the cavity. Seal members such as O-rings between the cavity component and the disc blade formed a seal for the coolant. Here, one problem is the O-rings must be replaced each time the disc blade is removed from the cavity component. Also, in each blade sharpening cycle, the back or rear surface of the stationary disc blade must be resurfaced to remove pitting caused by direct contact with the coolant. These issues add further downtime and expense to refurbishing the system.

Another inherent problem with the heavy disc blades are the operating costs associated with the blades. When material throughput for the pulverizing system becomes reduced to an unacceptable level, the disc blades must be replaced with new or re-sharpened blades. For some materials, for example, the disc blades become degraded after approximately 150 operating hours. A given disc blade, for example, is shipped to a supplier or third party for sharpening ten or more times before a minimum disposal thickness (e.g., ⅝ inch (1.58 cm)) is reached. The costs associated with continually sharpening the disc blades also include significant shipping costs. In some locations it costs more for shipping the disc blades back and forth than the cost of sharpening.

In prior mill assemblies, adjustment of the gap between the disc blades was controlled by a combination of adjustable spacers and attaching hardware. The spacers and attaching hardware, with respect to the lid and water jacket, were spaced apart from each other creating undesirable stresses on the water jacket and making it difficult to simultaneously adjust a given spacer and corresponding attaching hardware. Usually, an operator must repetitively loosen the attaching hardware and readjust the spacer before a desired gap is obtained due to the spaced apart configuration. Again, significant downtime of the system was associated with this trial-and-error type of adjustment.

Each material submitted to the pulverizing system for grinding has a temperature at which it is best ground. A preferred grinding temperature is normally slightly under the melting point of the material. If the grinding process temperature gets too high, the material being ground will liquefy and plug up the mill housing causing a "melt down" which can damage the tooling inside the mill housing and the mill housing itself if not shut down immediately. This operating temperature inside the mill housing is very important.

A "maximum temperature allowable" (e.g., a predetermined temperature less the "melt down" temperature) is set at a control panel and, based on a monitored temperature of the material in the disc mill assembly, a motor controller controls the speed of a feeder. For example, if the material temperature is below the maximum temperature, the speed of the feeder may be increased until a motor associated with the disc mill assembly reaches a maximum amperage. When the material temperature reaches the maximum temperature, the controller cuts back on the speed of the feeder to reduce the material temperature. At that point, the temperature in the mill housing is controlling the throughput of the system, rather than the amperage draw of the motors. Currently, local ambient air flows into the mill housing through static air inlet holes in the housing, a material inlet to the housing, and various other points (i.e., the housing is not required to be air tight). Neither of these input air streams are adjustable. Moreover, neither of these input air streams provide air that is cooler than local ambient air.

Thus, there is a particular need for an improved disc mill assembly in a pulverizing system and for a new type of disc blades for an improved disc mill assembly. Moreover, the disc mill assembly requires improved temperature control/regulation to overcome the above-noted problems.

SUMMARY

The invention contemplates various improvements to a disc mill and a new type of disc blade for the mill each of which overcome at least one of the above-mentioned problems and others in a simple, cost-efficient manner.

In one aspect of the invention, a disc mill assembly for a pulverizing system is provided. The disc mill assembly includes a housing, a flywheel received in the housing and adapted for being secured to an associated rotating spindle, a water jacket, first and second disc blades disposed in facing operative relation, each disc blade having a cutting surface, wherein the first disc blade is disposed adjacent the flywheel and the second disc blade is disposed adjacent the water jacket so the cutting surfaces are facing, and first and second ring clamps, the first ring clamp at least partially securing the first disc blade to the flywheel and the second ring clamp at least partially securing the second disc blade to the water jacket.

In another aspect of the invention, a disc blade for a disc mill assembly is provided. The disc blade includes an annular member formed by a generally planar first surface, a cutting surface opposite the first surface, an outer wall extending from the first surface to the cutting surface, and an inner wall extending from the first surface to the cutting surface, wherein the member has a thickness perpendicular to the first surface and cutting surface, an aperture through the central portion being the only opening through the thickness.

In another aspect of the invention, a method for controlling a temperature of material in a disc mill assembly having first and second disc blades is provided. The method includes: a) directing an adjustable input air stream toward the first and second disc blades, b) rotating at least the first disc blade, c) directing material to be ground toward the first and second disc blades, d) grinding material between the first and second disc blades into smaller particles, e) monitoring the temperature of the material in the disc mill assembly, and f) controlling at least one of the air stream directing step and the material directing step in response to the temperature monitoring step to maintain a temperature of the material within a predetermined threshold of a desired temperature.

One advantage of the present invention is that the disc blades can be provided for a much lower price than comparable previous disc blades.

Another advantage of the present invention is that there is no need for users of pulverizing system incorporating the improved disc mill assembly to have the disc blades sharpened, thereby eliminating sharpening costs, shipping costs associated with sharpening, and the inventory of temporary replacement disc blades required when disc blades were removed and returned for sharpening.

Still another advantage of the present invention is that the disc blades are lighter weight, thus shipping costs for replacement disc blades are lower.

Yet another advantage of the present invention is that setup and adjustment of a pulverizing system with the improved disc mill assembly is simplified and more reliable than comparable previous systems.

Another advantage of the present invention is that overall material throughput of a pulverizing system with the improved disc mill assembly is increased over comparable previous systems.

Still another advantage of the present invention is that overall operating costs for a pulverizing system with the improved disc mill assembly are less than comparable previous systems.

Still other benefits and advantages of the invention will become apparent to those of ordinary skill in the art upon reading and understanding the description of the invention provided herein.

BRIEF DESCRIPTION OF DRAWINGS

The invention is described in more detail in conjunction with a set of accompanying drawings.

DETAILED DESCRIPTION

Figure 1:
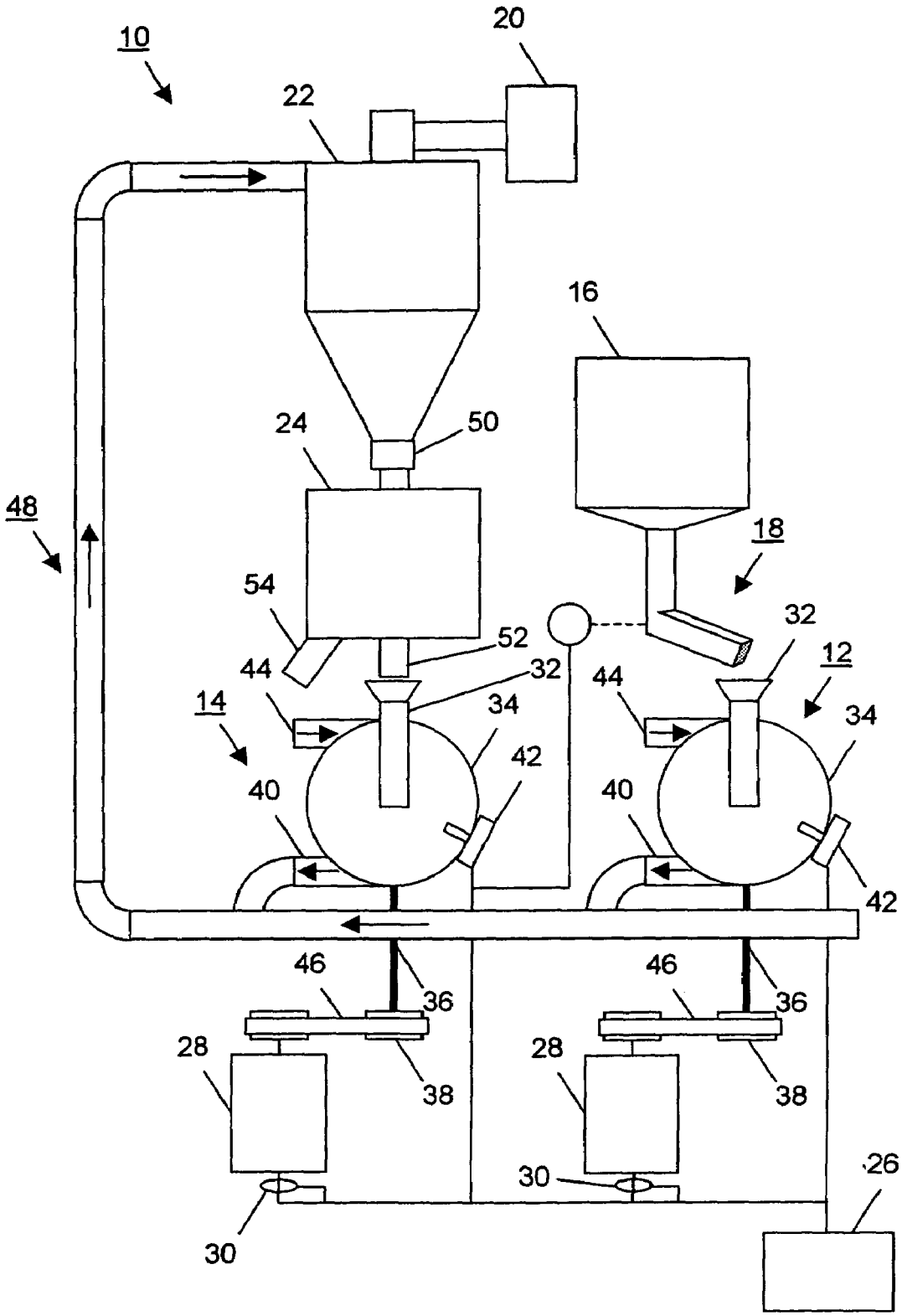
FIG. 1 is a schematic diagram of an embodiment of a pulverizing system with two improved disc mill assemblies.

While the invention is described in conjunction with the accompanying drawings, the drawings are for purposes of illustrating exemplary embodiments of the invention and are not to be construed as limiting the invention to such embodiments. In particular, dimensions, materials, and material processes identified in the drawings of the exemplary embodiment may be altered in various other embodiments of the invention. Moreover, typical tolerances, suitable for a given application, are understood to be associated with any dimensions, materials, and material processes identified in the drawings. It is understood that the invention may take form in various components and arrangement of components and in various steps and arrangement of steps beyond those provided in the drawings and associated description. Within the drawings, like reference numerals denote like elements unless specifically noted otherwise.

With reference to FIG. 1, an embodiment of a pulverizing system 10 includes two improved disc mill assemblies (i.e., a primary disc mill 12 and a secondary disc mill 14), as well as a feed hopper 16, a vibrating feeder 18, a blower 20, a cyclone 22, a sieve or sifter 24, a control panel 26, motors 28, and current sensors 30. Each of the disc mill assemblies 12, 14 preferably includes a material inlet 32, a housing 34, a spindle 36, a pulley 38, a mill outlet 40, and a temperature sensor 42. Each of the disc mill assemblies 12, 14 may also include an air inlet 44 in accordance with the present invention.

The control panel 26 is in communication with the vibrating feeder 18, blower 20, motors 28, current sensors 30, and temperature sensors 42. The motors 28 are in communication with respective pulleys 38 via belts 46. The feed hopper 16 is in communication with the vibrating feeder 18. The vibrating feeder 18 is in communication with the primary disc mill 12. The blower 20 is in communication with the cyclone 22. The cyclone 22 is in communication with the primary disc mill 12 and the secondary disc mill 14 via a duct system 48. The cyclone 22 is also in communication with sifter 24 via an air lock 50. The sifter 24 is in communication with secondary disc mill 14 via a recirculating port 52.

The control panel 26 starts the blower 20 to create a vacuum in the duct system 48 and starts the motors 28 which cause rotating disc blades in each improved disc mill assembly 12, 14 to rotate via the belts 46, pulleys 38, and spindles 36. Raw material (e.g., pellets or shredded material) to be ground is supplied to the feed hopper 16 and flows to the vibrating feeder 18. Examples of raw material include LLDPE, LDPE, HDPE, PVC, PBT, ABS, nylons, polyesters, or other polymers. These examples are conventional raw materials supplied to pulverizing mills. One skilled in the art will appreciate that the pulverizing system 10 may also be used to grind other materials. The speed of the vibrating feeder 18 is controlled by the control panel 26. By varying the speed of the vibrating feeder 18, the control panel 26 controls or regulates the amount of the raw material supplied to the primary disc mill 12 and thereby the corresponding throughput of the pulverizing system 10.

The raw material flows from the vibrating feeder 18 through the material inlet 32 to the primary disc mill 12. The primary disc mill 12 grinds the raw material into smaller particles using the rotating disc blade and a stationary disc blade. The negative pressure or vacuum in the duct system 48 removes particles from the primary disc mill 12 through the mill outlet 40 into the cyclone 22. The particles settle through the cyclone 22 into the sifter 24. An air lock 50 between the cyclone 22 and the sifter 24 ensures that the blower 18 does not draw air from the output of the cyclone 22 in a reverse direction. [00036] The sifter 24 separates particles according to size and routes particles that are smaller than a predetermined acceptable size to an exit port 54 for transport and/or collection as deliverable stock (e.g., powder). All other particles pass from the sifter 24 through a recirculating port 52 for re-introduction into the second disc mill 14. The secondary disc mill 14 grinds the particles into smaller particles that are output to the duct system 48 and introduced (e.g., vacuum-fed) into the cyclone 22 in the same manner as described for the primary disc mill 12. From the cyclone 22, the particles continue recirculating through the secondary disc mill 14 until they are a size that will pass through the exit port 54.

Typically, the primary disc mill 12 and the secondary disc mill 14 are designed and constructed the same, although differences between the disc mills of a given pulverizing system are possible. In other embodiments, a pulverizing system may include one or more improved disc mill assemblies. In still further embodiments, a pulverizing system may include one or more improved disc mill assemblies in combination with an unimproved disc mill assembly or even a different type of mill assembly. While the drawing shows disc mill assemblies 12, 14 with vertical spindles 36 and corresponding horizontal disc blades, other embodiments of the improved disc mill assembly may be oriented with a horizontal spindle and vertical disc blades.

The air inlet 44 in each of the disc mill assemblies 12, 14 is adapted for connection to an external air supply via conventional air duct. The air inlet 44 may include means for regulating or controlling air flow such as a damper to control the flow of air through the inlet. The damper is typically adjusted to maintain a desired temperature for the material being ground in a given improved disc mill assembly 12, 14. In one embodiment, ambient air from outside a building associated with the pulverizing system 10 is provided to the improved disc mill assemblies 12, 14 via the air inlets 44. In another embodiment, chilled air from a chiller is provided. In still another embodiment, for example, a breather or filter assembly is attached to the air inlet 44 to provide local ambient air.

During grinding operations, the control panel 26 compares measurements from the temperature sensors 42 and current sensors 30 to maximum allowable set points for material temperature and motor current, respectively. The maximum allowable material temperature is previously determined and represents a value below the "melting point" for the raw material. The maximum allowable current is also previously determined and represents a value below the maximum current ratings for the motors. In response to the sensor measurements, the control panel 26 increases or decreases the speed of the vibratory feeder to correspondingly increase or decrease the input of raw material to the primary disc mill 12.

If the material temperature is below the maximum allowable temperature, material throughput is driven by the load or current on the motors 28. Conversely, if the motor current is below the maximum allowable current, material throughput is driven by the material temperature in a given improved disc mill assembly 12, 14. In the latter case, the external air supply through the air inlet 44 typically enables increased material throughput by reducing the material temperature in the given improved disc mill assembly 12,14, particularly where the external air supply is either chilled air or ambient air from outside the building.

In various embodiments, the external air supply is switched between the chilled air supply, outside ambient air supply, and local ambient air supply. In another embodiment, the external air supply is an adjustable combination of any two or more external air supplies. If the air inlet 44 includes the damper, the amount of input air from the external air supply is adjusted to control the material temperature. This adjustment is performed in conjunction with initial and periodic setup of the pulverizing system or any time during grinding operations. Typically, the damper is adjusted manually. However, in other embodiments control of the damper is automated in conjunction with the sensor measurements and set points.

Figure 2:
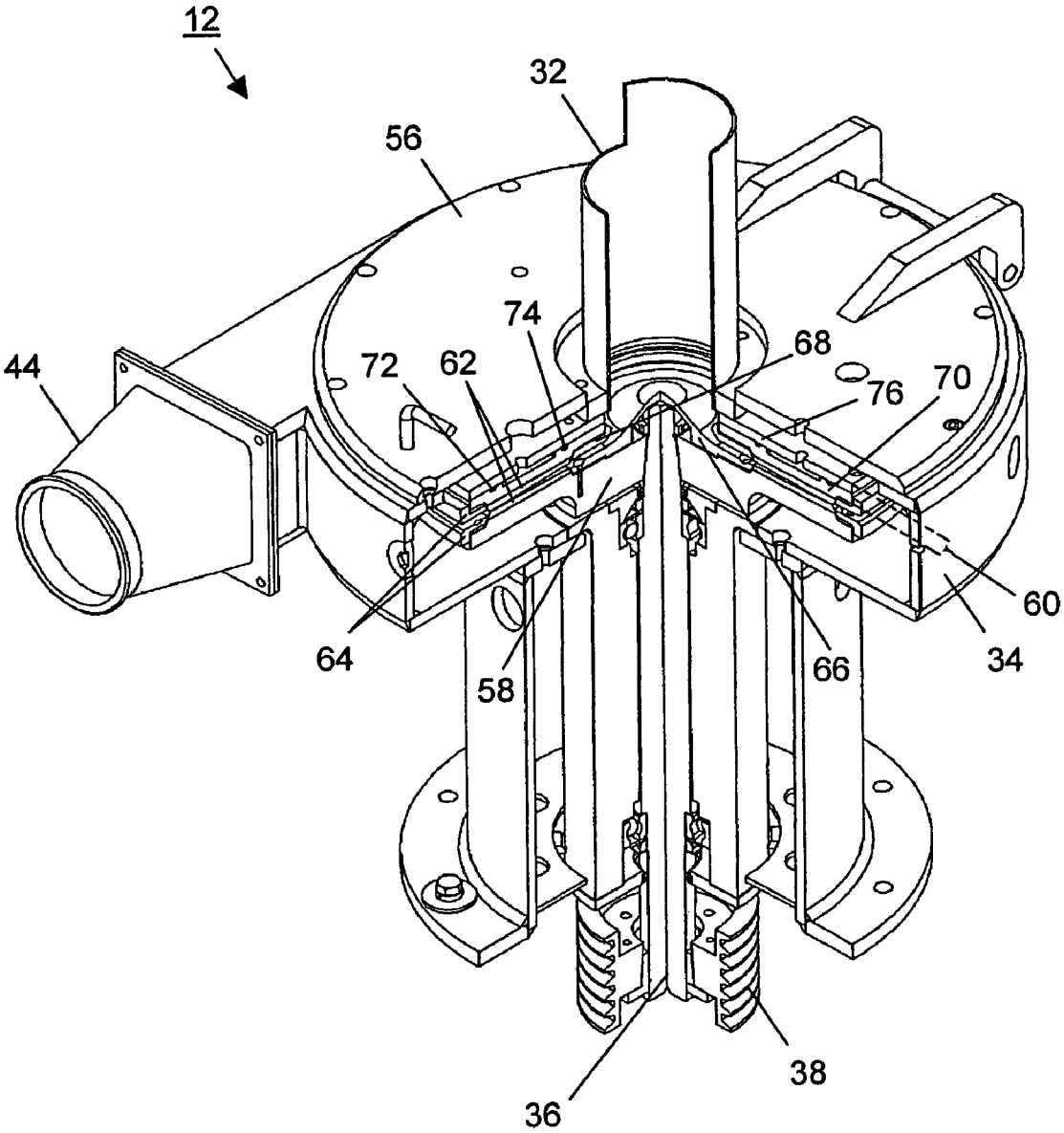
FIG. 2 is an isometric view of an embodiment of an improved disc mill assembly with a quarter section cut away along a vertical axis.

With reference to FIG. 2, an embodiment of an improved disc mill assembly 12 includes a material inlet 32, a housing 34, a spindle 36, a pulley 38, an air inlet 44, a lid 56, a flywheel 58, a water jacket 60, two disc blades 62, two outer ring clamps 64, a center hub clamp 66, and an inner ring clamp 68. Some embodiments do not require the center hub clamp 66 and/or the inner ring clamp 68. As shown, the water jacket 60 includes an upper portion 76, an outer O-ring 72, an inner O-ring 74, and a lower portion 70. In another embodiment, the water jacket 60 is a single component with an internal cavity for coolant.

The air inlet 44 is secured to the housing 34 and disposed to direct air from an external air supply toward material being ground by the disc blades 62 in response to a vacuum created in the disc mill assembly 12 by a blower 20 (FIG. 1). As shown by the position of the air inlet 44 with respect to the housing 34 and disc blades 62, air directed by the air inlet forms an input air stream that is at least partially tangential to the outer walls of the disc blades 62. In other embodiments, the air inlet 44 may be positioned differently with respect to the housing 34 and disc blades 62.

Figure 4:
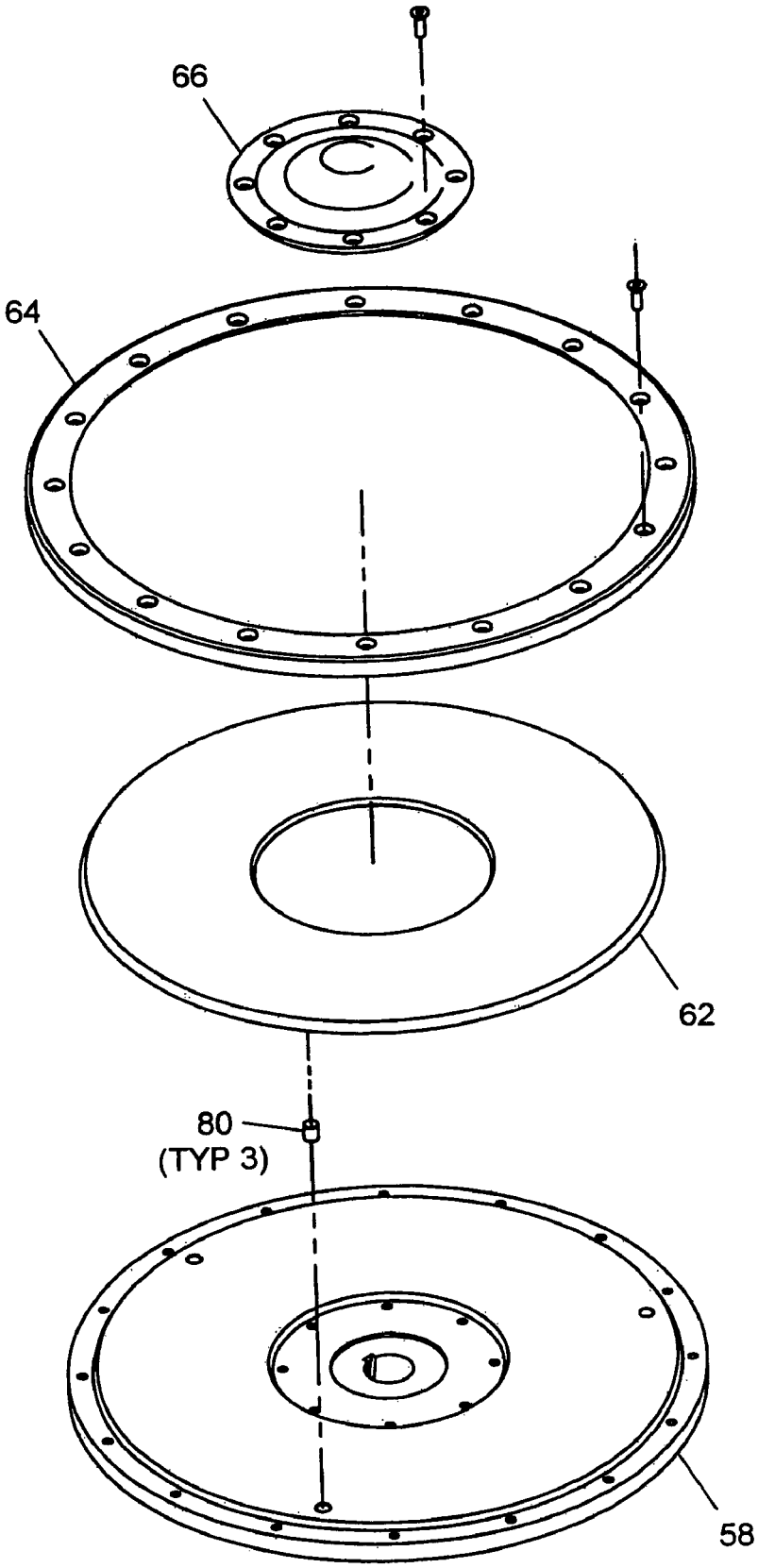
FIG. 4 is an exploded isometric view of an embodiment of a rotating disc assembly associated with an improved disc mill assembly.

With reference to FIGS. 2 and 4, the flywheel 58 includes a lower side and an upper side. The lower side of the flywheel 58 is secured to the spindle 36. The lower or rotating first disc blade 62 includes a generally planar surface facing the flywheel 58, a cutting surface opposite the planar surface, an outer wall extending from the planar surface to the cutting surface along an outer periphery of each surface, and an inner wall extending from the planar surface to the cutting surface forming an aperture through a central portion of the disc blade 62. The lower outer ring clamp 64 mates with the outer wall of the lower disc blade 62 and is secured to the upper side of the flywheel 58 thereby securing the lower disc blade 62 to the flywheel 58. The center hub clamp 66 mates with the inner wall of the lower disc blade 62 and is also secured to the upper side of the flywheel 58 thereby also securing the lower disc blade 62 to the flywheel 58. Accordingly, the lower disc blade 62 rotates in response to rotation of the spindle 36.

Figure 5:
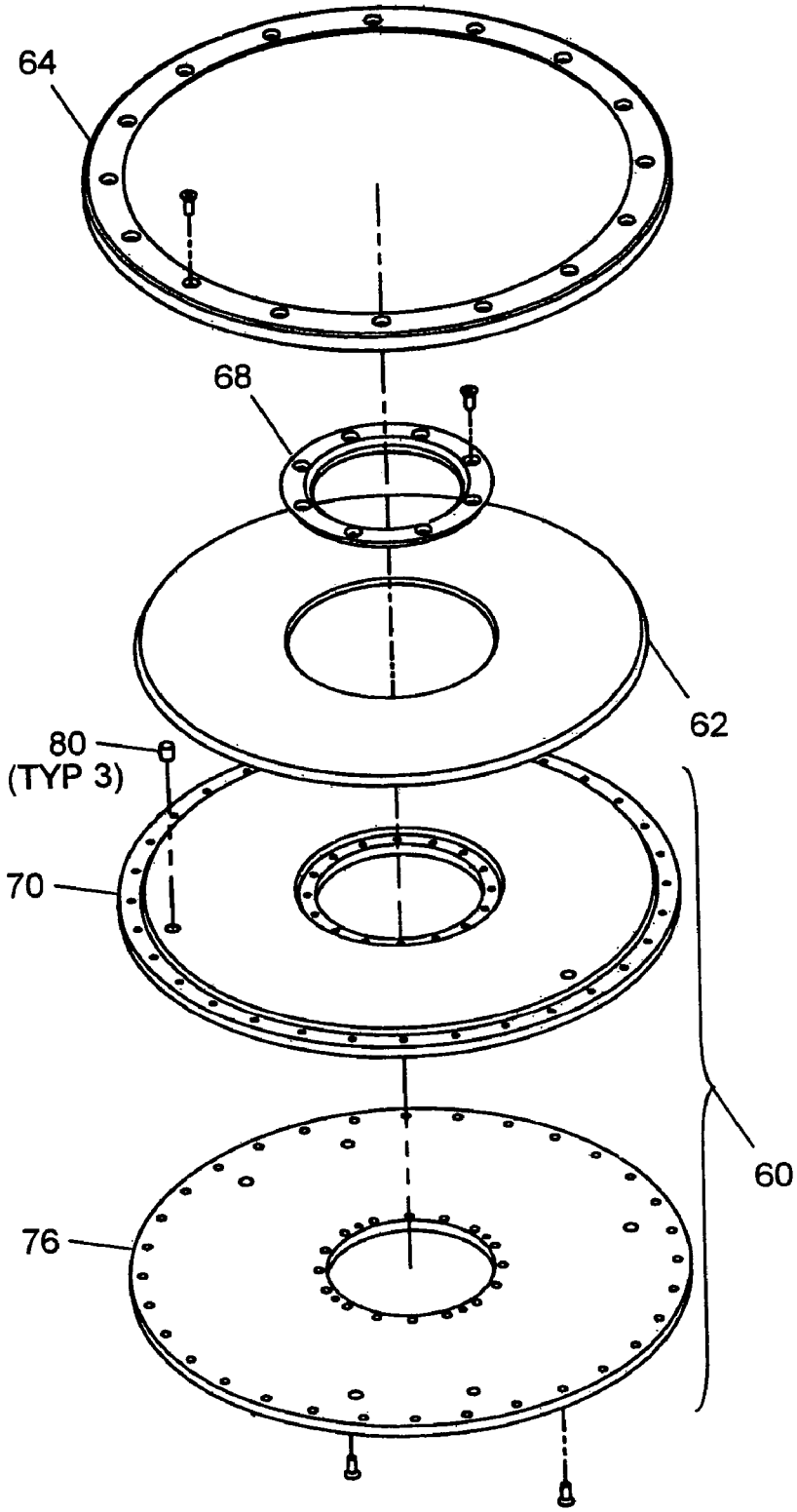
FIG. 5 is an exploded isometric view of an embodiment of a stationary disc assembly associated with an improved disc mill assembly.

With reference to FIGS. 2 and 5, the water jacket 60 includes an upper or first side and a lower or second side. The upper side of the water jacket 60 is secured to the lid 56. Like the lower disc blade 62, the upper disc blade 62 includes a generally planar surface, a cutting surface, an outer wall, and an inner wall. The upper outer ring clamp 64 mates with the outer wall of the upper disc blade 62 and is secured to the lower side of the water jacket 60 thereby securing the upper disc blade 62 to the water jacket 60. The inner ring clamp 68 mates with the inner wall of the upper disc blade 62 and is also secured to the lower side of the water jacket 60 thereby also securing the upper disc blade 62 to the water jacket 60. Accordingly, the upper disc blade 62 is stationary.

Figure 8:
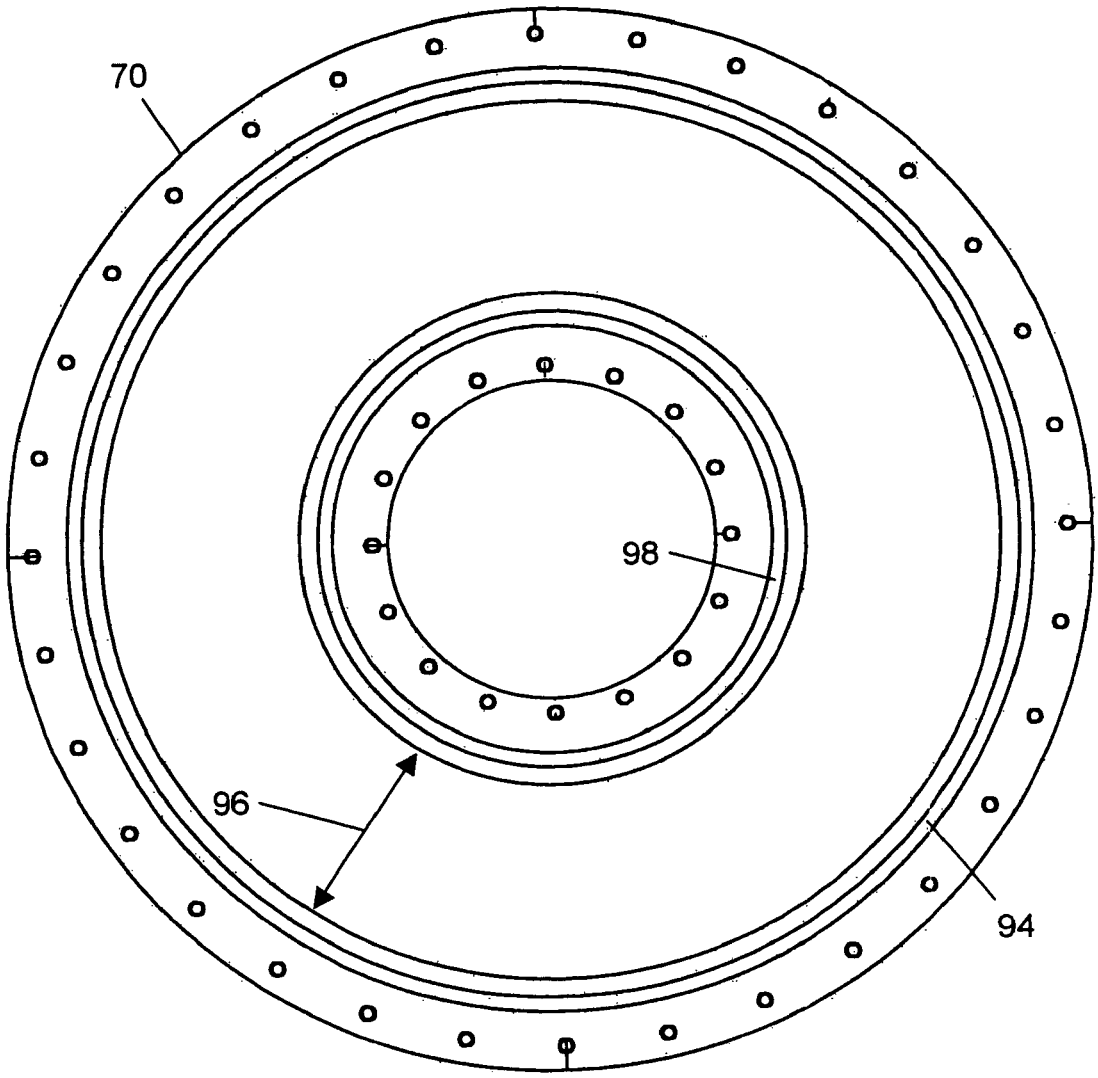
FIG. 8 is a top view of an embodiment of a lower portion of a water jacket associated with an improved disc mill assembly.

The lower portion 70 of the water jacket 60 includes an exterior side formed by the lower side of the water jacket 60, an interior side opposite the exterior side, an outer wall extending from the exterior side to the interior side along an outer periphery of each side, and an inner wall extending from the exterior side to the interior side forming an aperture through a central area of the lower portion 70. A surface of the interior side of the lower portion 70 includes an outer groove 94 (FIG. 8), a central groove 96 (FIG. 8), and an inner groove 98 (FIG. 8). The outer groove 94 (FIG. 8) receives the outer O-ring 72. The central groove 96 (FIG. 8) forms a cavity for receiving coolant. The inner groove 98 (FIG. 8) receives the outer O-ring 74. The upper portion 76 of the water jacket 60 includes an exterior side formed by the upper side of the water jacket 60, an interior side opposite the exterior side and adapted to mate with the interior side of the lower portion 70, an outer wall extending from the exterior side to the interior side along an outer periphery of each side, and an inner wall extending from the exterior side to the interior side forming an aperture through a central area of the upper portion 76. With the O-rings 72, 74 properly positioned in the grooves 94, 98 (FIG. 8) of the lower portion 70, the upper portion 76 is secured to the lower portion 70 forming the water jacket 60. In the improved disc mill assembly 12, maintenance of the water jacket 60 (e.g., replacement of O-rings 72, 74) is not required in conjunction with replacement of the upper disc blade 62 as in previous disc mill assemblies.

Figure 3:
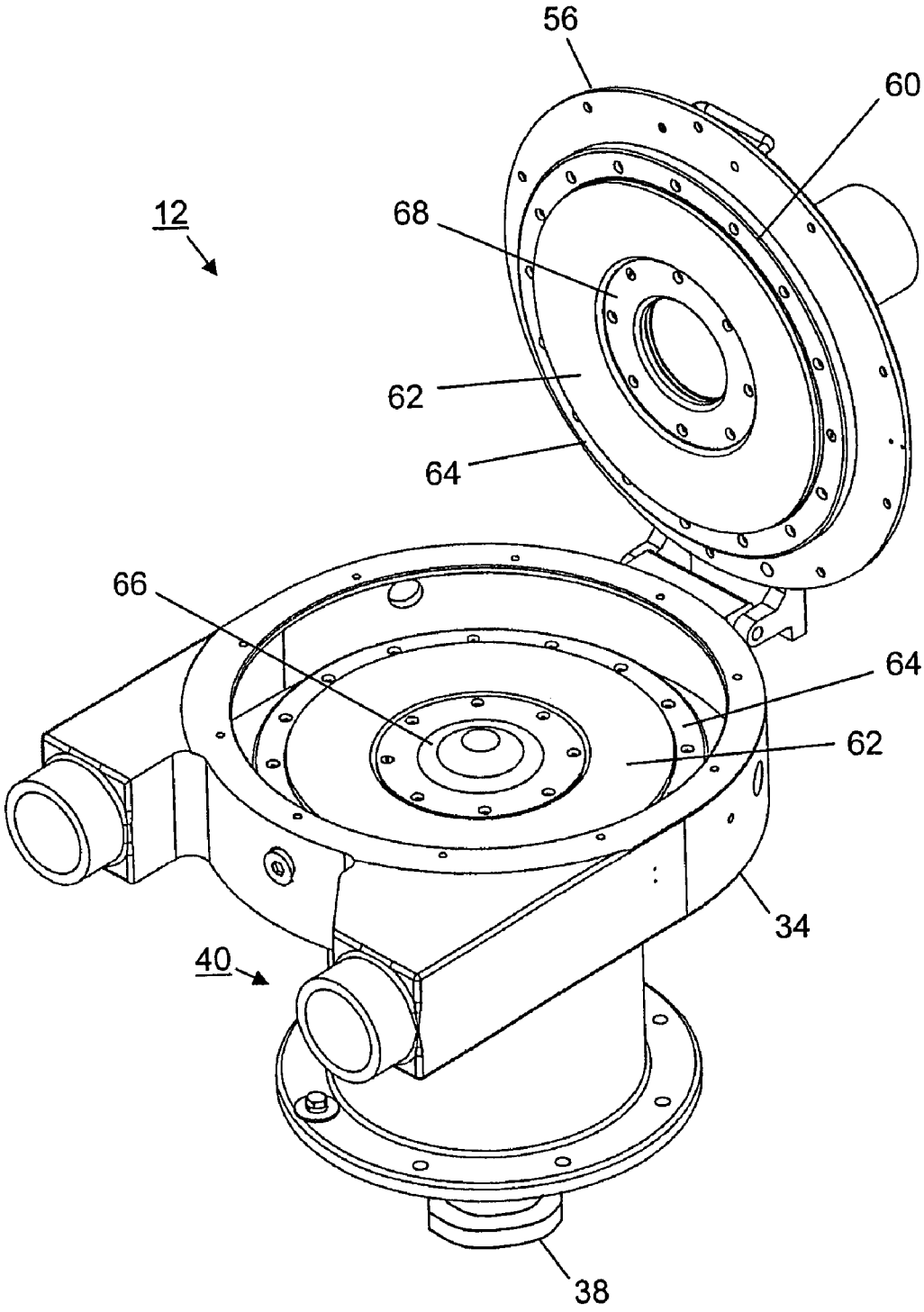
FIG. 3 is another isometric view of an embodiment of an improved disc mill assembly with its lid opened.

With reference to FIG. 3, the material inlet 32, housing 34, pulley 38, a material outlet 40, the air inlet 44, lid 56, water jacket 60, disc blades 62, outer ring clamps 64, center hub clamp 66, and inner ring clamp 68 are shown. Some embodiments do not require the center hub clamp 66 and/or the inner ring clamp 68. With the lid 56 open, cutting surfaces of the disc blades 62 are visible.

The disc blade 62 is a lightweight, hardened blade with respect to previous disc blades. For example, the weight of the disc blade 62 is about 75% less than comparable previous disc blades. Similarly, the disc blade 62 is ⅓ to ½ as thick as comparable previous disc blades. The material and hardening selected for the disc blade 62 enables the thickness to be reduced beyond the threshold currently recommended for disposal of re-sharpened discs (e.g., ⅝ inch (1.58 cm)). The corresponding reduction in material due to the reduced thickness significantly reduces the fabrication cost of the blades. Likewise, the corresponding reduction in weight reduces shipping costs associated with replacement blades. Combined, the lower costs associated with the disc blades 62 permit disposal of the blades, rather than repetitive re-sharpening. For example, previously blades may have been returned to a supplier or third party for sharpening up to ten times before disposal. In this example, if the cost of the light weight, hardened blades is 1/10 of the initial cost plus costs for re-sharpening (including shipping), a disposable blade concept becomes feasible and cost effective. If the hardened blades also last longer than one re-sharpening cycle for the previous blades, the disposable blade concept becomes feasible at an even higher cost ratio.

As shown, lightweight, hardened disc blades 62 are held in place by spring tempered clamping rings. The lower (i.e., rotating) disc blade 62 is held in place by the outer clamp ring 64 and the center hub clamp 66. Similarly, the upper (i.e., stationary) disc blade 62 is held in place by the outer clamp ring 64 and the inner clamp ring 68. Three pins 80 (FIGS. 4 and 5) protrude from the flywheel 58 and the water jacket 60 which prevent the lower and upper disc blades 62, respectively, from certain undesired rotational movement. Rotational movement of the lower disc blade 62 is resisted, except for rotational movement due to rotation of the flywheel 58 during normal operations, particularly rotational movement opposing the normal rotation of the flywheel 58. Rotational movement of the upper disc blade 62 is resisted, particularly rotational movement in the same direction as the normal rotation of the flywheel 58 and lower disc blade 62. The pins 80 (FIGS. 4 and 5) extend into shallow blind holes (i.e., elongated cavities) in the back side of the disc blade 62. The clamping rings (i.e., 64, 66, 68), pins 80, and blind holes replace the plurality of through mounting holes in previous disc blades and corresponding mounting bolts, allowing the disc blade 62 to maintain its structural integrity and strength. In various embodiments of the improved disc blade assembly 12, thickness may be added to the flywheel 58 and the water jacket 60 to maintain the overall strength of the disc blade assembly 12.

Each disc blade 62 is a single member with a generally planar side that is generally circular, an opposite side with a cutting surface that is also generally circular, an outer wall extending from the planar side to the opposite side along an outer periphery of each side, and an inner wall extending from the planar side to the opposite side forming an aperture through a central portion of the disc blade 62. Preferably, there are no openings through the thickness of the disc blade 62 other than the aperture through the central portion. In other words, the aperture is preferably the only opening through the thickness of the disc blade 62 so that the ground material remains between the disc blade.

The cutting surface of the disc blade 62 includes a plurality of cutting edges extending radially from a central vertical axis at a predetermined relatively constant angle toward the outer periphery of the cutting surface. The cutting edges also have a predetermined relatively constant slope with respect to the central vertical axis and the outer periphery. Typically, the slope of all the cutting edges in a given disc is the same. The slope, for example, may be downwardly sloping from the outer periphery toward the central vertical axis. Each cutting edge is formed by a rising surface and a trailing surface, wherein the rising surface of a given cutting edge meets the trailing surface of a preceding cutting edge and the trailing surface of the given cutting edge meets the rising surface of a succeeding cutting edge. When viewed from the side, the cutting surface of the disc blade has a serrated appearance. The rising surfaces rise to respective cutting edges at a predetermined slope. Similarly, trailing surfaces fall from respective cutting edges at a predetermined slope. The predetermined slopes for the rising and trailing surfaces need not be the same. Although, typically, the slope of all the rising surfaces is the same and the slope of all the trailing surfaces is the same.

This type of cutting surface is well known in the industry and, typically, the cutting edges are referred to as teeth. It is well known that the number of teeth can vary, as well as the various angles and pitches associated with the teeth. The invention does not rely on any particular configuration for the cutting surface. For example, the angles and/or pitches associated with the teeth on a given disc blade do not have to be constant with respect to individual teeth or the same from tooth to tooth. Accordingly, the invention is intended to apply to any configuration of cutting surface suitable for disc blades used in disc mills. Likewise, the invention does not rely on any particular diameter for the disc blade 62. While several standard diameters for disc blades have developed in the industry, the invention is intended to apply to disc blades of any diameter, as well as the standard diameters.

The disc blade 62 has a thickness perpendicular to the generally planar side and the opposite side. Generally, the thickness of the disc blade 62 is less than previous disc blades. In one embodiment, the thickness of the disc blade is less than 25/64 inch (0.99 cm). In another embodiment, the thickness of the disc blade is less than ½ inch (1.27 cm). In still another embodiment, the thickness of the disc blade is less than ⅝ inch (1.58 cm). Of course other blade thicknesses that sufficiently withstand the stresses associated with grinding operations in the improved disc mill assembly 12 are also contemplated. In one embodiment, the disc blade 62 is constructed from material including about 11-27% Chromium, preferably about 20% Chromium.

In one embodiment, the outer wall of the disc blade 62 slopes inwardly from the planar side to the opposite side. Accordingly, the outer wall is adapted for mating with the outer ring clamp 64 that at least partially secures the disc blade 62 to either the flywheel 58 or the water jacket 60. Similarly, in one embodiment, the inner wall of the disc blade 62 slopes outwardly from the planar side to the opposite side. Accordingly, the inner wall is adapted for mating with an inner clamp (e.g., the center hub clamp 66 that at least partially secures the disc blade 62 to the flywheel 58 or the inner ring clamp 68 that at least partially secures the disc blade 62 to the water jacket 60).

Typically, the disc blade 62 is used in the improved disc mill assembly 12, 14 of the pulverizing system 10 (FIG. 1) until a sharpness associated with the cutting surface is degraded, upon which the disc blade is disposed rather than sharpened.

With reference to FIG. 4, an embodiment of a rotating disc assembly associated with an improved disc mill assembly 12 includes a flywheel 58, a disc blade 62, an outer ring clamp 64, a center hub clamp 66, and three pins 80. Use of more or less pins 80 is envisioned. The pins 80 are elongated having a generally cylindrical shape. In other embodiments, the pins 80 can be in different shapes. Furthermore, some embodiments do not require the center hub clamp 66 and/or the pins 80. For example, in another embodiment, the flywheel 58 can be fabricated with elongated protrusions extending toward the disc blade 62 eliminating the need for the pins 80.

The flywheel 58 includes an upper or first side. The disc blade 62 includes a generally planar surface facing the flywheel 58 and a cutting surface opposite the planar surface. The pins 80 are secured to the upper side of the flywheel 58 with a protruding portion extending toward the planar surface of the disc blade 62. The protruding portion of the pins 80 mates with corresponding elongated cavities in the planar surface of the disc blade 62. The three pins 80 and corresponding cavities are generally equally spaced with respect to the flywheel 58 and disc blade 62. When the disc blade 62 is secured to the flywheel 58 (see FIG. 2.), the pins 80 provide resistance against undesired rotational movement of the disc blade 62 in a direction perpendicular to the cutting surface, particularly in a direction opposing normal rotational movement of the flywheel 58.

With reference to FIG. 5, an embodiment of a stationary disc assembly associated with an improved disc mill assembly 12 includes a water jacket 60, a disc blade 62, an outer ring clamp 64, an inner ring clamp 68, three pins 80. As shown, the water jacket 60 includes the lower portion 70 and the upper portion 76. Although not shown, this embodiment of the water jacket 60 also includes the outer O-ring 72 (FIG. 2) and the inner O-ring 74 (FIG. 2). Note that the stationary disc assembly is shown inverted (i.e., upside down) from its actual installation in the improved disc mill assembly 12 (see FIGS. 2 and 3). Also note that the pins 80 in the stationary disc assembly are the same as those in the rotating disc assembly (FIG. 4). As such, the same characteristics, limitations, and alternatives for the pins 80 discussed above for the rotating disc assembly apply to use of the pins 80 in the stationary disc assembly. For example, use of more or less pins 80 is envisioned, as well as pins in different shapes. Similarly, the lower portion 70 of the water jacket 60 can be fabricated with elongated protrusions extending toward the disc blade 62 eliminating the need for the pins 80.

The lower portion 70 of the water jacket 60 includes a lower side. The disc blade 62 includes a generally planar surface facing the lower portion 70 of the water jacket 60 and a cutting surface opposite the planar surface. The pins 80 are secured to the lower side of the lower portion 70 of the water jacket 60 with a protruding portion extending toward the planar surface of the disc blade 62. The protruding portion of the pins 80 mates with corresponding elongated cavities in the planar surface of the disc blade 62. The pins 80 and corresponding cavities are generally equally spaced with respect to the lower portion 70 of the water jacket 60 and disc blade 62. When the disc blade 62 is secured to the lower portion 70 of the water jacket 60 (see FIG. 2.), the pins 80 provide resistance against rotational movement of the disc blade 62 in a direction perpendicular to the cutting surface.

Figure 6:
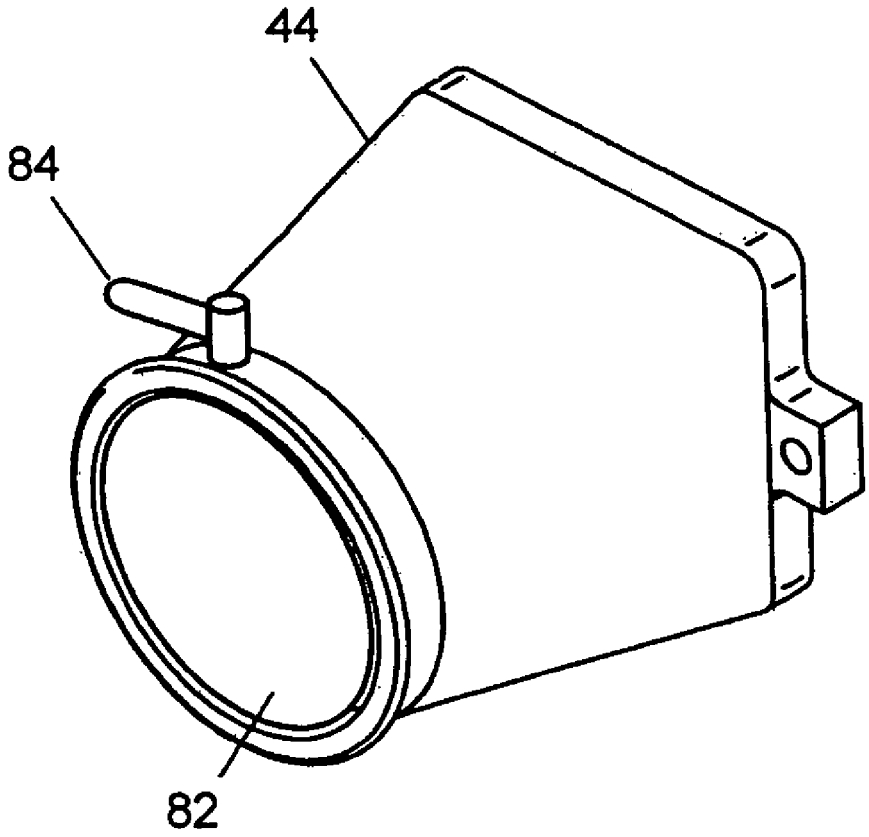
FIG. 6 is an isometric view of an embodiment of an adjustable air inlet associated with an improved disc mill assembly.

With reference to FIG. 6, an embodiment of an adjustable air inlet 44 associated with an improved disc mill assembly 12 includes a damper 82 and a handle 84. As shown, the damper 82 is closed generally blocking air flow through the air inlet 44. The damper 82 pivots along a central vertical axis in response to turning the handle 84 in the horizontal plane on the vertical axis. In the embodiment being described, for example, turning the handle 90 degrees in a counter-clockwise direction opens the damper 82 to allow maximum air flow through the air inlet 44. Alternate control mechanisms are envisioned including different types of handles and automated control, for example, by servo or stepper mechanisms.

Figure 7:
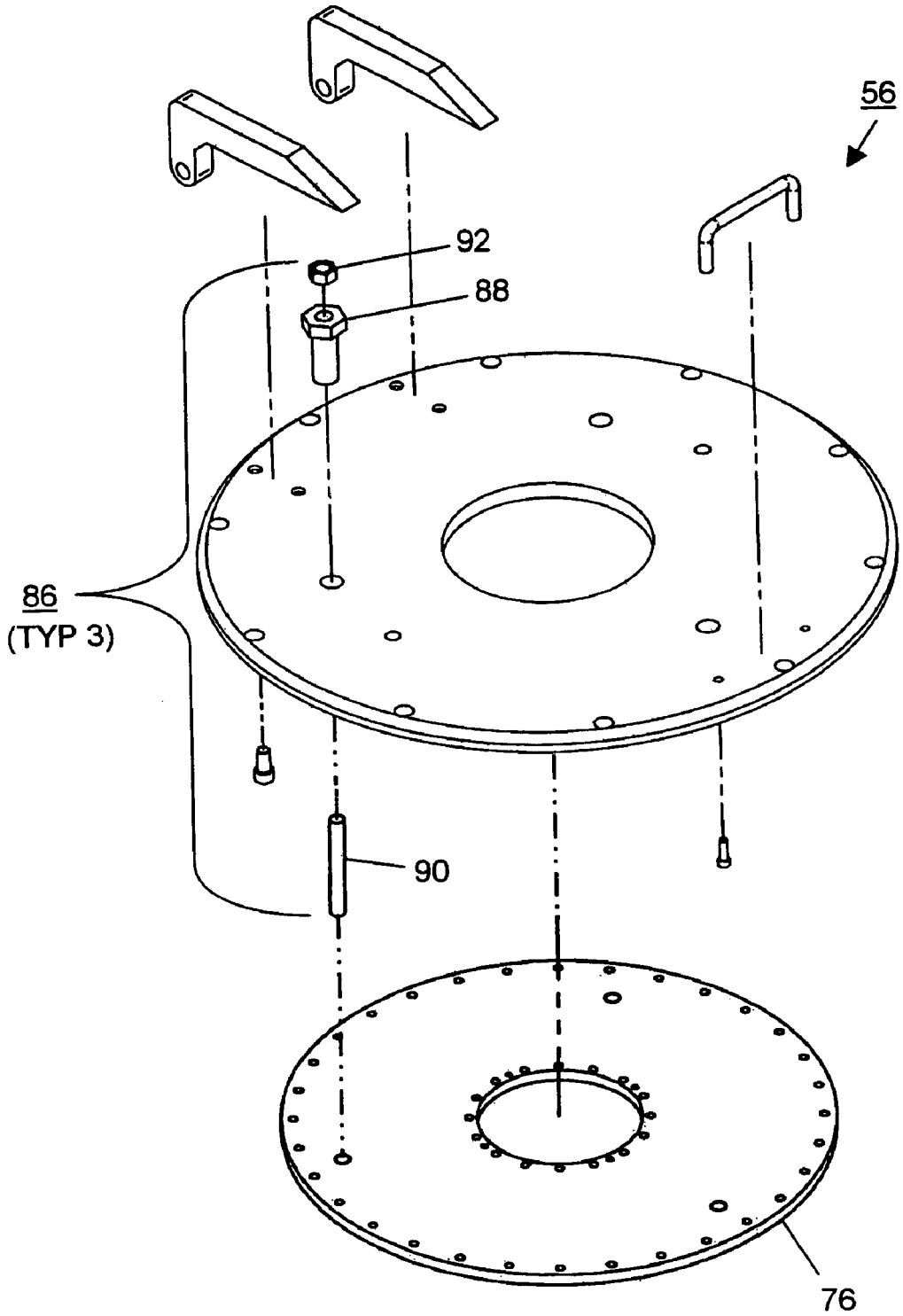
FIG. 7 is an exploded isometric view of an embodiment of a blade height adjustment mechanism associated with an improved disc mill assembly.

With reference to FIG. 7, an embodiment of a blade height adjustment mechanism 86 associated with an improved disc mill assembly 12 includes an adjustable elongated spacing member (i.e., a bolt 88) and an adjustable elongated securing member (i.e., a threaded rod 90 and a nut 92). One or more alternate hardware items may be used in additional embodiments of the spacing member and/or securing member of the blade height adjustment mechanism 86. The drawing depicts a particular embodiment of an improved disc mill assembly 12 with multiple blade height adjustment mechanisms 86. However, more or less blade height adjustment mechanisms 86 are envisioned. The blade height adjustment mechanisms 86 are generally equally spaced with respect to the lid 56 and the disc blades 62 (FIG. 2). In the embodiment being described, the blade height adjustment mechanisms 86 are shown in conjunction with a lid 56 and an upper portion 76 of a water jacket 60 (FIG. 5). Some embodiments of the improved disc mill assembly 12 may not require blade height adjustment mechanisms 86.

The blade height adjustment mechanism 86 co-locates the spacing and attaching hardware components concentrically to simplify adjusting the gap between the disc blades 62 and reduce undesirable stresses on the water jacket 60. Generally, the blade height adjustment mechanism 86 includes an adjustable spacing component with a hollow central core along its axial length. The attaching hardware component extends through the spacing component and secures the upper portion 76 of the water jacket 60 (FIG. 5) to the lid 56. Since the spacing and attaching hardware components are co-located, both can be adjusted simultaneously reducing the time required for an operator to set the gap to a desired dimension. Typically, the improved disc mill assembly 12 includes multiple blade height mechanism spaced apart so that adjustment of the gap between the disc blades is properly balanced.

The lid 56 includes an exterior side and an interior side. The upper portion 76 of the water jacket 60 (FIG. 5) includes an exterior side facing the interior side of the lid 56. The water jacket 60 (FIG. 5) is secured to the lid 56 by the blade height adjustment mechanisms 86. The blade height adjustment mechanism 86 adjusts the stationary disc blade assembly (FIG. 5) to a desired spaced apart relation (e.g., 0.030 inch (7.6 mm)) from the rotating disc blade assembly (FIG. 4).

The adjustable elongated spacing member has a central aperture along its axial length to adjust the water jacket 60 to a desired spaced apart relation from the lid, thereby adjusting the stationary disc blade 62 (FIG. 5) to a desired spaced apart relation from the rotating disc blade 62 (FIG. 4). The adjustable elongated securing member extends through the central aperture of the spacing member to secure the water jacket 60 (FIG. 5) to the lid 56 when the desired spaced apart relation between the stationary disc blade 62 (FIG. 5) and the rotating disc blade 62 (FIG. 4) is achieved.

As shown, each spacing member is a bolt 88 having a central aperture along its axial length. The bolts 88 mate with threaded holes in the lid 56 and abut against the upper portion 76 of the water jacket 60 (FIG. 5). Turning a bolt 88 clockwise pushes the water jacket 60 (FIG. 5) away from the lid 56, thereby decreasing the gap between the disc blades 62 (FIG. 2). Conversely, turning a bolt 88 counter-clockwise allows the securing member to pull the water jacket 60 (FIG. 5) closer to the lid 56, thereby increasing the gap between the disc blades 62 (FIG. 2).

As shown, the securing member includes a threaded rod 90 and a nut 92. An end of the threaded rods 90 is captively secured to the upper portion 70 of the water jacket 60 (FIG. 5) and extends away from the water jacket 60 toward the lid 56. An opposite end of the threaded rods 90 extends through the aperture of the spacing member when the water jacket 60 (FIG. 5) is installed (FIG. 5). The nuts 92 mate with the end of the threaded rods 90 extending through the aperture of the spacing members, thereby securing the water jacket 60 (FIG. 5) to the lid 56. Turning a nut 92 in a first direction, e.g., clockwise, pulls the water jacket 60 (FIG. 5) toward the lid 56, thereby increasing the gap between the disc blades 62 (FIG. 2). Conversely, turning a nut 92 in the opposite direction, e.g., counter-clockwise, lowers the water jacket 60 (FIG. 5) with respect to the lid 56, thereby decreasing the gap between the disc blades 62 (FIG. 2) and enabling subsequent adjustment of the spacing member to secure the water jacket 60 (FIG. 5) to the lid 56.

With reference to FIG. 8, an embodiment of a lower portion 70 of a water jacket 60 associated with an improved disc mill assembly 12 includes an interior side (FIG. 2) with an outer groove 94, a central groove 96, and an inner groove 98. The outer groove 94 receives the outer O-ring 72 (FIG. 2). The central groove 96 forms a cavity associated with the water jacket 60 (FIG. 2) for receiving coolant. The inner groove 98 receives the outer O-ring 72 (FIG. 2).

While the invention is described herein in conjunction with exemplary embodiments, it is evident that many alternatives, modifications, and variations will be apparent to those skilled in the art. Accordingly, the embodiments of the invention in the preceding description are intended to be illustrative, rather than limiting, of the spirit and scope of the invention. More specifically, it is intended that the invention embrace all alternatives, modifications, and variations of the exemplary embodiments described herein that fall within the spirit and scope of the appended claims or the equivalents thereof.

The invention claimed is:

1. An apparatus for a pulverizing system, including:

first and second disc blades disposed in facing operative relation, each disc blade formed by a generally planar first surface, a cutting surface opposite the first surface, an outer wall extending from the first surface to the cutting surface, and an inner wall extending from the first surface to the cutting surface, each disc blade having a thickness perpendicular to the first surface and cutting surface, at least one disc blade having an aperture through the central portion being the only opening through the thickness of the corresponding disc blade; and a first ring clamp at least partially securing the first disc blade to a first component adjacent to the first surface of the first disc blade;

wherein the first ring clamp mates with the outer wall of the first disc blade.

2. The apparatus as set forth in claim 1, wherein the first surface of at least one disc blade includes a plurality of elongated cavities adapted to receive a corresponding plurality of elongated protrusions projecting from a component adjacent to the first surface toward the corresponding disc blade, wherein undesired rotational movement of the disc blade is resisted when the protrusions are received in the cavities.

3. The apparatus as set forth in claim 1, further including:

a second ring clamp at least partially securing the second disc blade to a second component adjacent to the first surface of the second disc blade.

4. The disc mill assembly as set forth in claim 3, further including:

a third ring clamp at least partially securing the second disc blade to the second component.

5. The apparatus as set forth in claim 3, wherein the second component includes a lid.

6. The apparatus as set forth in claim 1, further including:

a center hub clamp at least partially securing the first disc blade to the first component.

7. The apparatus as set forth in claim 1, wherein the first component includes a flywheel.

8. The apparatus as set forth in claim 1, further including:

an air inlet secured to the housing and disposed to direct air from an external air supply toward material being ground by the first and second disc blades in response to a vacuum created in the disc mill assembly by a blower associated with the pulverizing system.

9. The apparatus as set forth in claim 8, wherein the air inlet is an adjustable air inlet, the adjustable air inlet including:

a damper to adjust the amount of air flowing through the air inlet.

10. The apparatus as set forth in claim 8, wherein the air directed by the air inlet forms an input air stream that is at least partially tangential to outer walls of the first and second disc blades.

11. The apparatus as set forth in claim 8, wherein the external air supply is at least partially supplied from at least one of a group including:

i) a device producing chilled air, ii) ambient air from outside a building associated with the pulverizing system, and iii) ambient air within the building and in a vicinity of the pulverizing system.

12. An apparatus for a pulverizing system, including:

a housing;

a flywheel received in the housing and adapted for being secured to an associated rotating spindle;

a lid removably fitted to the housing;

first and second disc blades received in the housing and disposed in facing operative relation, each disc blade formed by a generally planar first surface, a cutting surface opposite the first surface, an outer wall extending from the first surface to the cutting surface, and an inner wall extending from the first surface to the cutting surface, each disc blade having a thickness perpendicular to the first surface and cutting surface, at least one disc blade having an aperture through the central portion being the only opening through the thickness of the corresponding disc blade, wherein the first disc blade is disposed in relation to the flywheel and the second disc blade is disposed in relation to the lid; and first and second ring clamps, the first ring clamp at least partially securing the first disc blade to the flywheel and the second ring clamp at least partially securing the second disc blade to the lid.

13. The apparatus as set forth in claim 12, further including:

a center hub clamp at least partially securing the first disc blade to the flywheel.

14. The apparatus as set forth in claim 12, further including:

a third ring clamp at least partially securing the second disc blade to the lid.

15. An apparatus for a pulverizing system, including:

a disc blade formed by a generally planar first surface, a cutting surface opposite the first surface, an outer wall extending from the first surface to the cutting surface, and an inner wall extending from the first surface to the cutting surface, wherein the disc blade has a thickness perpendicular to the first surface and cutting surface and an aperture through a central portion of the thickness; and an outer ring clamp at least partially securing the disc blade to a component adjacent to the first surface of the disc blade;

wherein the outer ring clamp mates with the outer wall of the disc blade.

16. The apparatus as set forth in claim 15 wherein the aperture through the central portion is the only opening through the thickness.

17. The apparatus as set forth in claim 15, wherein the first surface includes a plurality of elongated cavities adapted to receive a corresponding plurality of elongated protrusions projecting from a component adjacent to the first surface toward the disc blade, wherein undesired rotational movement of the disc blade is resisted when the protrusions are received in the cavities.

18. The apparatus as set forth in claim 15, wherein the disc blade is constructed from material including about 11-27% Chromium.

* * * * *